US010161134B2

(12) United States Patent
Rees

(10) Patent No.: US 10,161,134 B2
(45) Date of Patent: Dec. 25, 2018

(54) WATER DIRECTING APPARATUS

(71) Applicant: Canale Catcher LLC, Santa Fe, NM (US)

(72) Inventor: Brian Rees, Santa Fe, NM (US)

(73) Assignee: Canale Catcher LLC, Santa Fe, NM (US)

( * ) Notice: Subject to any disclaimer, the term of this patent is extended or adjusted under 35 U.S.C. 154(b) by 0 days.

(21) Appl. No.: 15/209,753

(22) Filed: Jul. 13, 2016

(65) Prior Publication Data

US 2017/0121978 A1 May 4, 2017

Related U.S. Application Data

(60) Provisional application No. 62/249,995, filed on Nov. 3, 2015.

(51) Int. Cl.
*E04D 13/04* (2006.01)

(52) U.S. Cl.
CPC ..... *E04D 13/0445* (2013.01); *E04D 13/0409* (2013.01); *E04D 13/0481* (2013.01)

(58) Field of Classification Search
CPC . E04D 13/04; E04D 13/0409; E04D 13/0445; E04D 13/0481; E04D 13/0645; E04D 2013/0495
USPC ..... 52/302.1, 11
See application file for complete search history.

(56) References Cited

U.S. PATENT DOCUMENTS 2,777,405 A * 1/1957 Ager ..... E04D 13/0645 52/16
4,641,464 A * 2/1987 Andersson ..... E04D 13/08 137/615
4,837,987 A * 6/1989 Fender ..... E04D 13/0645 52/11
5,678,360 A * 10/1997 Fort ..... E04D 13/0645 210/474
6,141,916 A * 11/2000 Shackelford ..... E03F 3/046 210/163
6,185,889 B1 * 2/2001 Gilgan ..... E04B 7/00 52/11
6,202,366 B1 * 3/2001 Snyder ..... E02D 27/02 52/169.5
6,263,618 B1 * 7/2001 Jones ..... E04D 13/0645 210/459
6,282,844 B1 * 9/2001 Marable ..... E04D 13/064 52/11

(Continued)

*Primary Examiner* — Ryan D Kwiecinski
(74) *Attorney, Agent, or Firm* — V Gerald Grafe

(57) ABSTRACT

The present invention provides apparatuses that allow water from canales to be captured and communicated with water collection systems for storage or dispersal. Embodiments of the present invention accommodate existing canales with minimal or no modification to the canale or building or roof structure. Example embodiments of the present invention provide an apparatus with a catchment portion defining a volume that accepts water from a canale and communicates water to a collection system (where a collection system can communicate with a storage system or a dispersal system). The catchment portion is mounted to the canale using an attachment portion of the apparatus such that water from the canale enters the catchment portion, but such that excess water can overflow the catchment portion and fall to the ground.

12 Claims, 9 Drawing Sheets

(56) References Cited

U.S. PATENT DOCUMENTS

| | | | | |
|---|---|---|---|---|
| 8,286,390 | B2 * | 10/2012 | Leahy | E04D 13/0645 52/11 |
| 9,316,000 | B2 * | 4/2016 | Pendley | E04D 13/031 |
| 2002/0152691 | A1 * | 10/2002 | Wade | E04D 13/0767 52/11 |
| 2004/0226869 | A1 * | 11/2004 | McClure | C02F 1/004 210/163 |
| 2005/0102927 | A1 * | 5/2005 | Wade | E03F 5/0407 52/160 |
| 2008/0229673 | A1 * | 9/2008 | LaMorte | E04D 13/08 52/12 |
| 2011/0107683 | A1 * | 5/2011 | Ringuette | E04D 13/064 52/12 |
| 2011/0203191 | A1 * | 8/2011 | Argentina | E04D 13/0645 52/12 |
| 2012/0240480 | A1 * | 9/2012 | Hutchings, Jr. | E04D 13/064 52/16 |
| 2013/0111824 | A1 * | 5/2013 | Rees | E04D 13/064 52/12 |
| 2013/0118625 | A1 * | 5/2013 | Bell | E04D 13/08 138/37 |
| 2015/0345144 | A1 * | 12/2015 | Yildiz | E04D 13/076 52/12 |
| 2017/0342716 | A1 * | 11/2017 | Sinclair | E04D 13/0481 |
| 2018/0228141 | A1 * | 8/2018 | Blackford | A01M 29/34 |

* cited by examiner

WATER DIRECTING APPARATUS

FIELD OF THE INVENTION

This invention relates to collection and direction of water, and more specifically to the collection of water from rainwater channels in roofs.

SUMMARY OF THE INVENTION

The present invention provides apparatuses that allow water from canales to be captured and communicated with water collection systems for storage or dispersal. Embodiments of the present invention accommodate existing canales with minimal or no modification to the canale or building or roof structure. Embodiments of the present invention provide for capture of water while allowing overflow to exit the canale if water flow exceeds the capacity of the collection system, e.g., in heavy rains or blocked water collection or dispersal systems.

Example embodiments of the present invention provide an apparatus with a catchment portion defining a volume that accepts water from a canale and communicates water to a collection system (where a collection system can communicate with a storage system or a dispersal system). The catchment portion is mounted to the canale using an attachment portion of the apparatus such that water from the canale enters the catchment portion, but such that excess water can overflow the catchment portion and fall to the ground.

BRIEF DESCRIPTION OF THE DRAWINGS

Various aspects and attendant advantages of one or more exemplary embodiments and modifications thereto will become more readily appreciated as the same becomes better understood by reference to the following detailed description, when taken in conjunction with the accompanying drawings.

DESCRIPTION OF INVENTION

Figure 1:
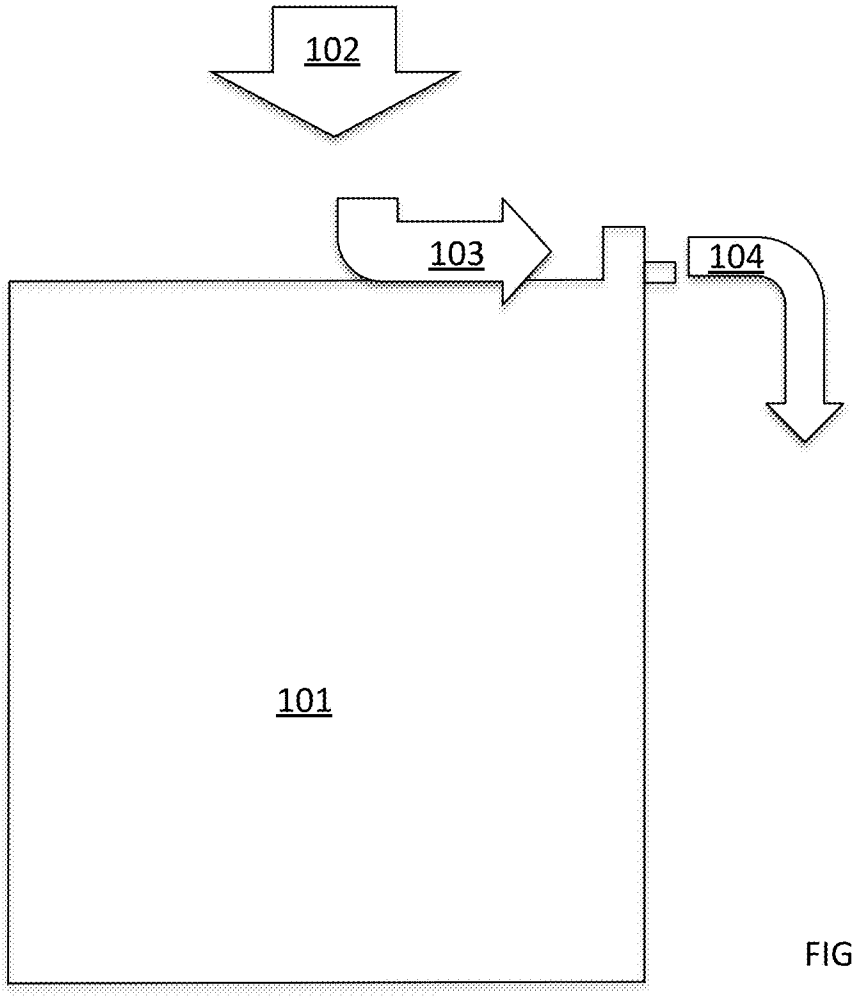
FIG. 1 is a schematic illustration of a building 101 with a substantially flat roof.

In many arid areas of the world, and in particular the American Southwest, buildings are sometimes constructed with roofs that are nearly flat, such as ¼" of vertical change in 12" of horizontal distance. This style of roof and building is sometimes called Santa Fe style.

Rainwater from these nearly flat roofs is frequently conveyed from the roof through one or more troughs that extend from the surface of the roof material through the building wall and project from the outer surface of the wall, typically from 2 inches to 16 inches, with longer distances more common. These troughs are sometimes called canales. Canales are frequently constructed of sawn lumber lined with sheet metal, and can, as an example, have an internal width of about 8 inches. As further examples, canales can be made of other materials such as galvanized steel or rigid foam, and can have other widths such as 6 inches. Rainwater that falls onto the roof flows across the roof to the canale, through the canale, and onto the ground. The canale provides a means for water to fall to the ground and away from the building wall and foundation.

Saving or harvesting rainwater in arid climates water is highly desirable, and present methods of collecting rainwater from canale systems suffer various disadvantages. The ground below the canale can be modified with gravel, aggregates, stones, cobbles, collection cisterns, or collection and distribution piping, or combinations of these methods, to utilize the rainwater. When rain falls during windy conditions the draining rainwater can blow against the side of the house or away from rainwater collection systems if not contained, and if persistent light rainfall occurs much of it can be lost to windblown spray. When heavy rainfall occurs draining water can overshoot collection systems.

Example embodiments of the present invention provide a downspout connector apparatus for collecting water from canale-type roof drains. An example embodiment comprises an apparatus defining a collection inlet, accepting water flowing into the apparatus from the outlet of a canale, and directing the flow of water to a downspout connector for directing the water to downspouts or other water direction systems. The collection inlet is open to the flow of water from a canale, or other similar water-draining outlet from a nearly flat roofing system. The apparatus has a bottom and walls that are angled so as to direct water to the outlet of the apparatus, and hence to a downspout connector that can be directly attached to the apparatus. The apparatus is configured to attach to the canale or other water draining outlet, such as by tabular projections or straps from the apparatus that can be integral to the connector, or separately constructed and attached to or around the connector and canale or drain outlet. Nails or screws can be used, if needed, to attach the apparatus to the canale or other associated structures. Example embodiments can be mounted with canales without requiring modification of or damage to (e.g., holes cut into the bottom of) existing canales.

Example embodiments of the present invention provide a collection apparatus for rainwater flowing from a canale due to gravity, through an opening in the apparatus that faces upwards to accept the water flowing downwards from the discharge of the canale, a bottom, sides, and top that channel water to an outlet that is substantially rectangular in cross section and sized to accept a downspout connector that further connects to other downspout sections for fluidically conveying water to water storage, distribution, or dispersal apparatuses.

Example embodiments of the present invention provide a rainwater collection device that allows for collecting rainwater at the outlet of a canale and fluidically conveying the rainwater to a downspout connector for connection to other downspout and distribution piping, tubing, hose, or similar means of conveying water for storage, distribution, or dispersal.

Example embodiments of the present invention provide for rainwater collection from square, round, ovoid, rectangular, or combinations of these shapes used to drain nearly flat roofs.

Example embodiments of the present invention provide for the collection of rainwater from canales or similar roof drain outlets without having to cut, drill, or modify such apparatuses other than placing a fastener such as a nail or screw into the drain device and without penetrating roofing material.

Example embodiments of the present invention provide for collection of rainwater without having to modify the roof or drain methods or to place a dam or other obstruction in or on the roof drain outlet to cause water level to rise enough to flow up over the flange of and into a drain device fitting and therefore causing ponding or puddling of waters which could then leak through leak paths not normally exposed to standing water, and could allow insect infestations due to puddled water.

Example embodiments of the present invention provide for water to freely flow out of the roof drain outlet and into its original flow path in the event the rainwater collection device clogs, or is blocked or overwhelmed.

FIG. 1 is a schematic illustration of a building 101 with a substantially flat roof. Rain 102 falling hits the roof and moves 103 along the roof to one or more canales. Water 104 exiting the canale falls to the ground. The falling water can erode and damage the ground, and can run off without being captured for later use.

Figure 2:
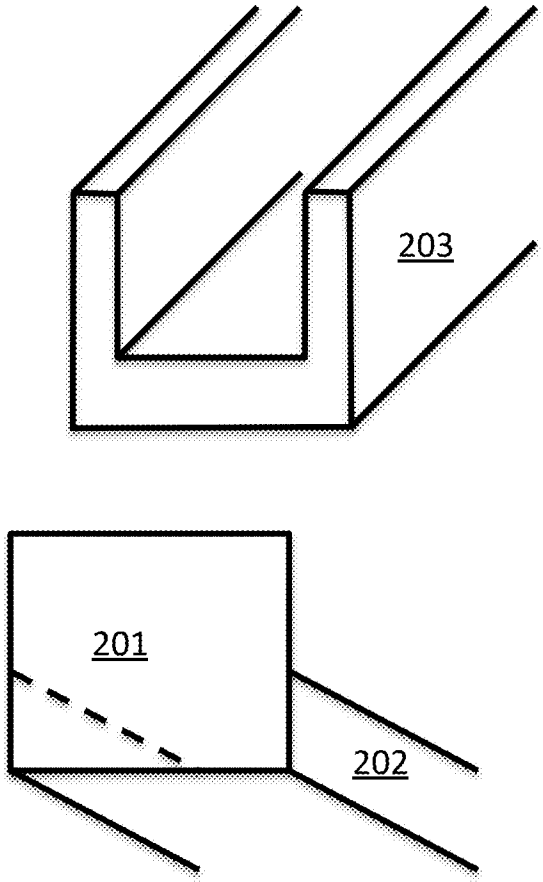
FIG. 2 is a schematic illustration of an example apparatus according to the present invention.

FIG. 2 is a schematic illustration of an example apparatus according to the present invention. The apparatus comprises a plate 201 that mounts with portion 202 defining a channel. The apparatus mounts with a canale 203 such that the plate substantially blocks the path water would otherwise take exiting the canale, and diverts the flowing water into the channel 202. The apparatus can be made of bended metal, plastic, cast, or any other suitable production technique. The apparatus can mount with the canale by straps, adhesive, friction fit members, etc. (not shown in this figure).

Figure 3:
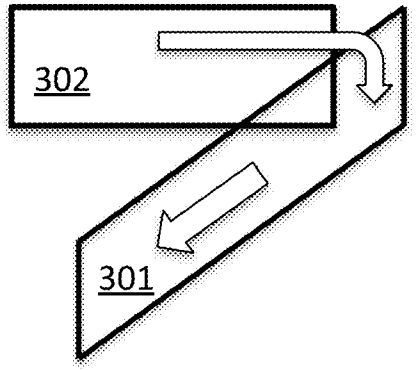
FIG. 3 is a schematic illustration of an example apparatus according to the present invention.

FIG. 3 is a schematic illustration of an example apparatus according to the present invention. The apparatus 301 mounts with a canale 302 as described before. Water flowing through canale is diverted by the plate of the apparatus, and then flows down the apparatus. Conventional rain gutters or other water diversion or collection devices can be mounted with the apparatus to divert or collect the water flowing through the apparatus.

FIGS. 5-10 are schematic illustrations of an example embodiment of the present invention, formed by folding sheet metal and riveting at appropriate locations. The example shown is configured to mount with a canale having a generally rectangular cross section.

FIGS. 11-14 are schematic illustrations of an example embodiment of the present invention, formed by folding and curving sheet metal. The example embodiment is configured to mount with a canale having a generally circular cross section. Two straps 1102 encircle the apparatus and the canale to provide a secure mounting relationship. A pipe 1103 is shown in the figure, representative of the canale. From the figure, it can be seen that water exiting the pipe (canale) can fall into the apparatus and be channeled to an outlet 1104 configured to engage a water collection or diversion system such as a downspout. Excess water flow, and debris, can travel over the top of the apparatus and fall, avoiding clogs in the apparatus and the water collection or diversion system.

Figure 4:
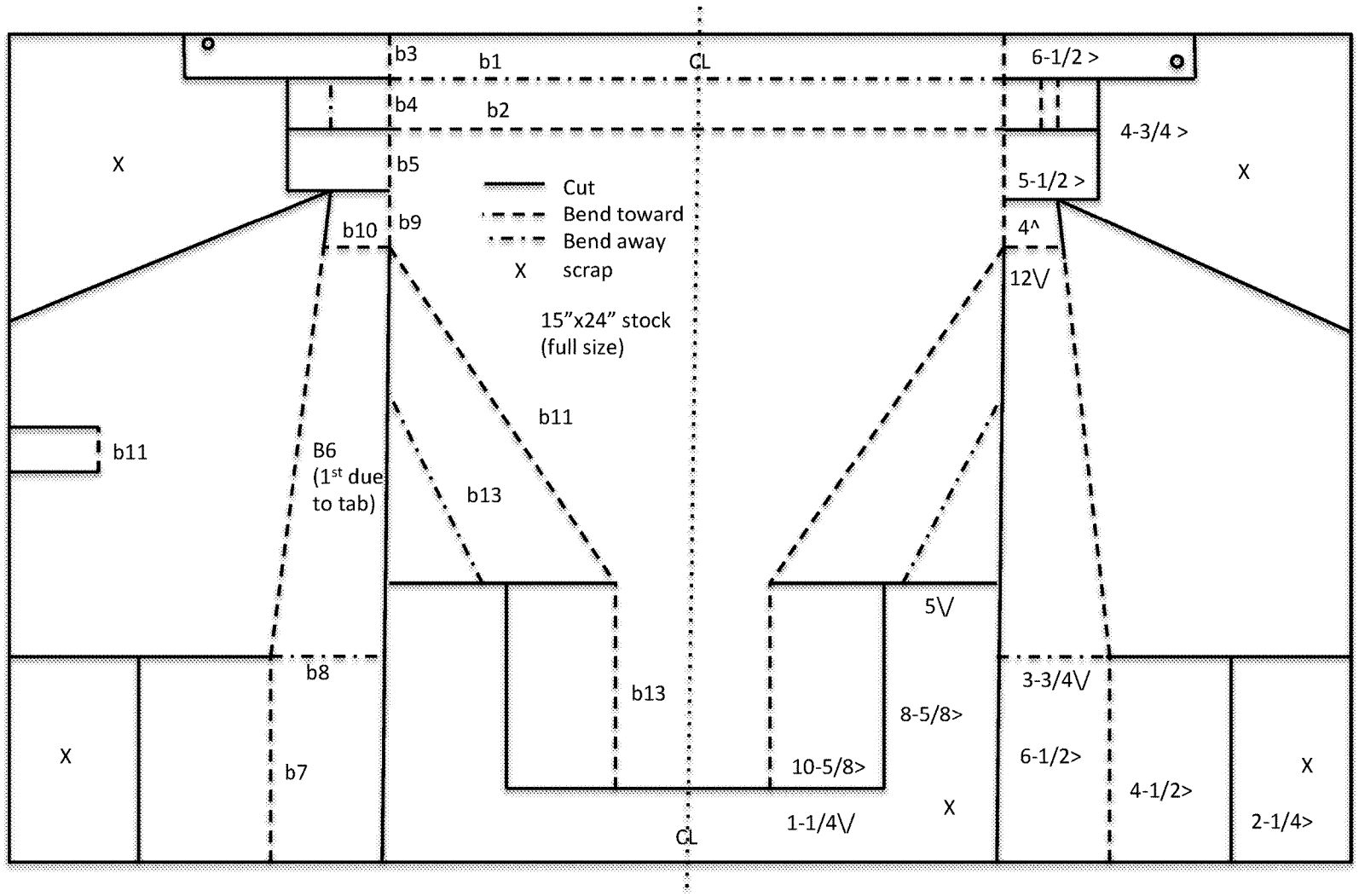
FIG. 4 is a diagram of cuts and folds suitable for making an example embodiment of the present invention.
Figure 5:
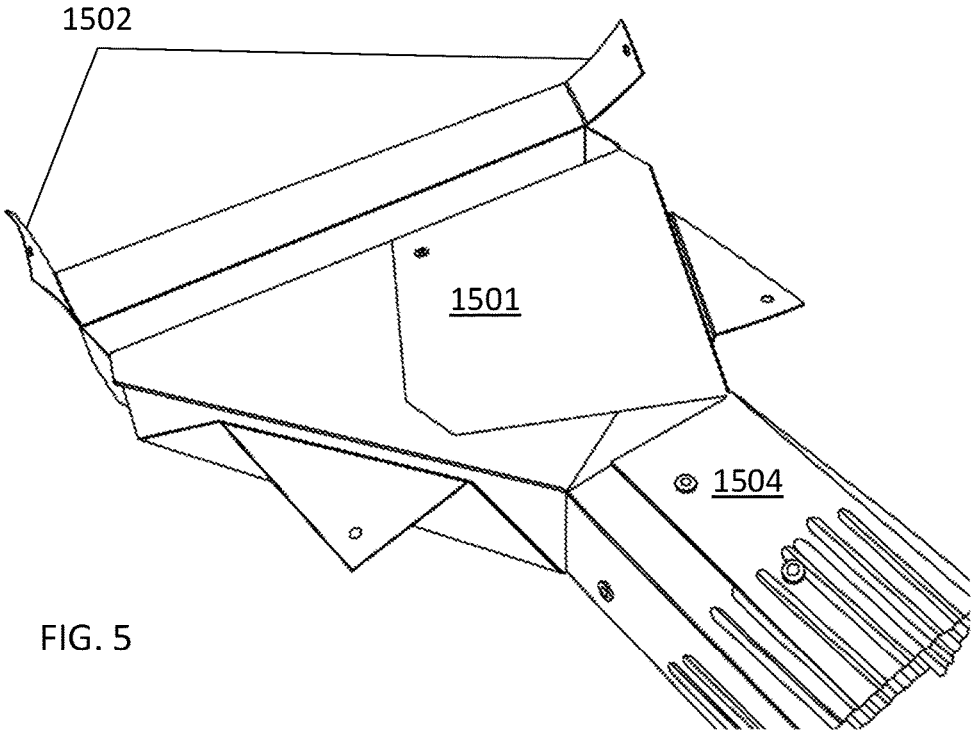
FIG. 5 is a schematic illustration of an example embodiment of the present invention, formed by folding sheet metal and riveting at appropriate locations.
Figure 6:
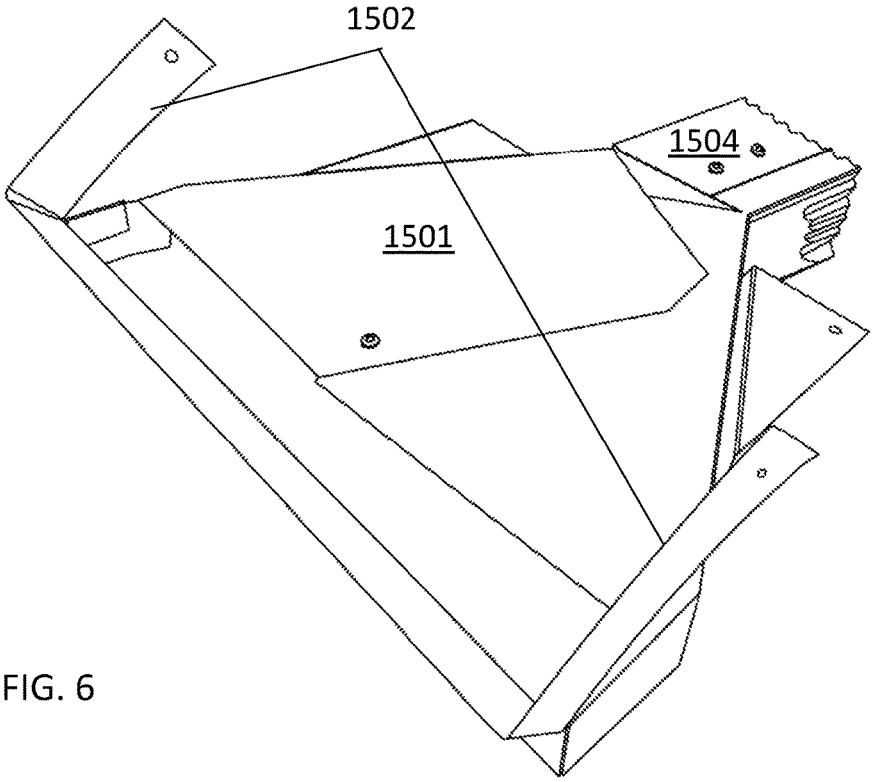
FIG. 6 is a schematic illustration of an example embodiment of the present invention, formed by folding sheet metal and riveting at appropriate locations.
Figure 7:
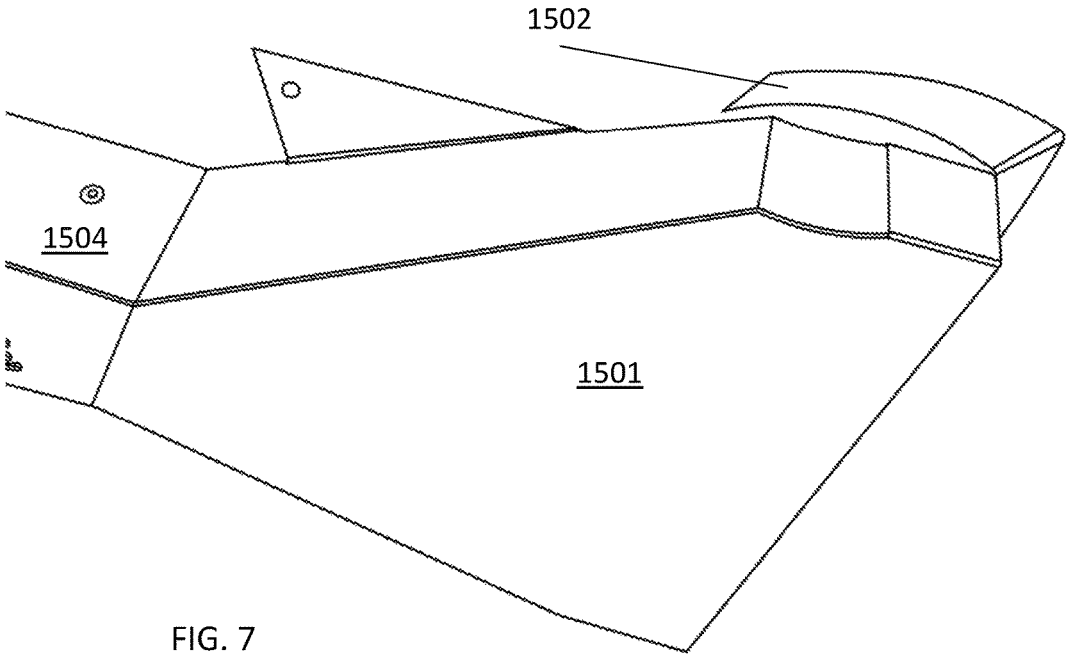
FIG. 7 is a schematic illustration of an example embodiment of the present invention, formed by folding sheet metal and riveting at appropriate locations.
Figure 8:
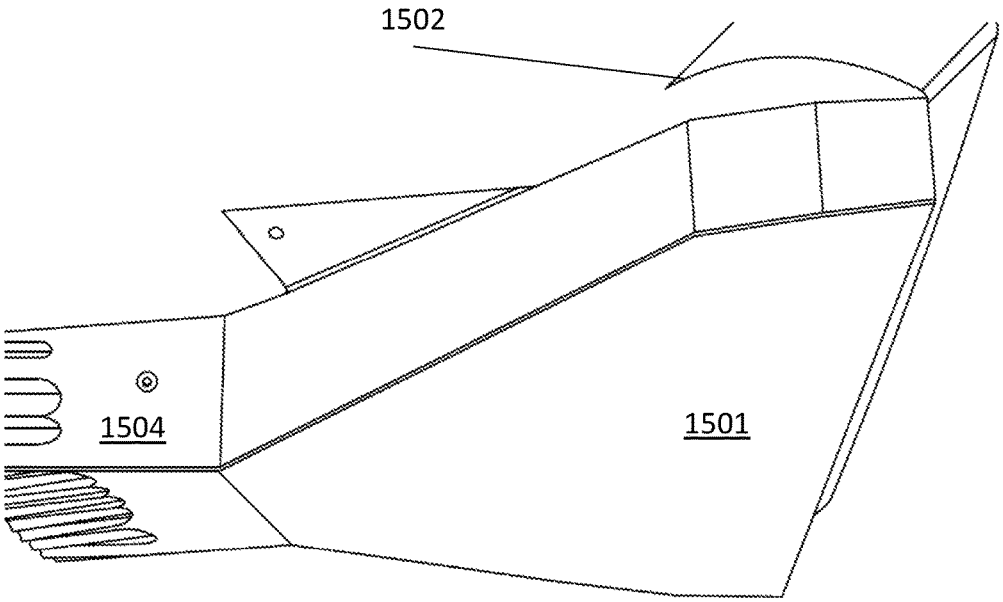
FIG. 8 is a schematic illustration of an example embodiment of the present invention, formed by folding sheet metal and riveting at appropriate locations.
Figure 9:
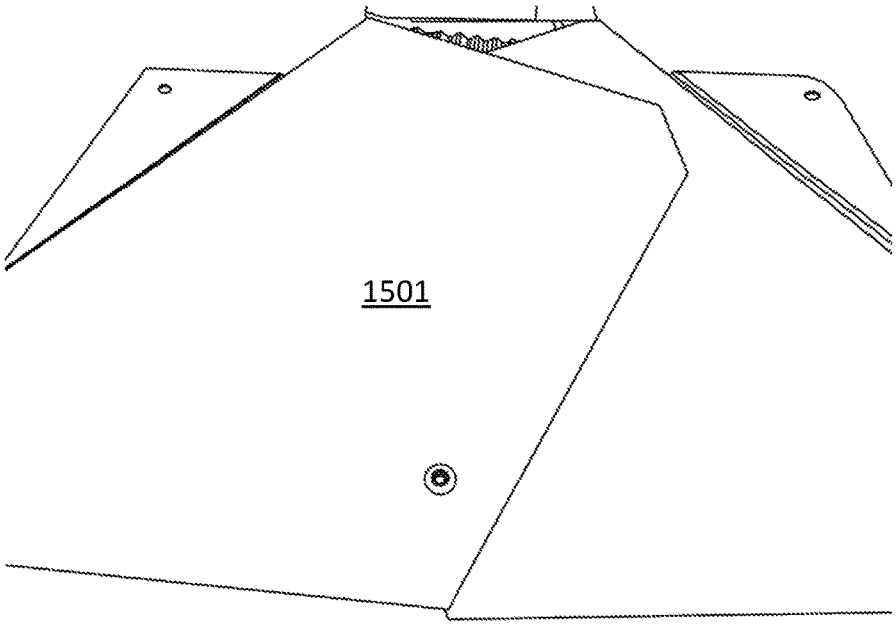
FIG. 9 is a schematic illustration of an example embodiment of the present invention, formed by folding sheet metal and riveting at appropriate locations.
Figure 10:
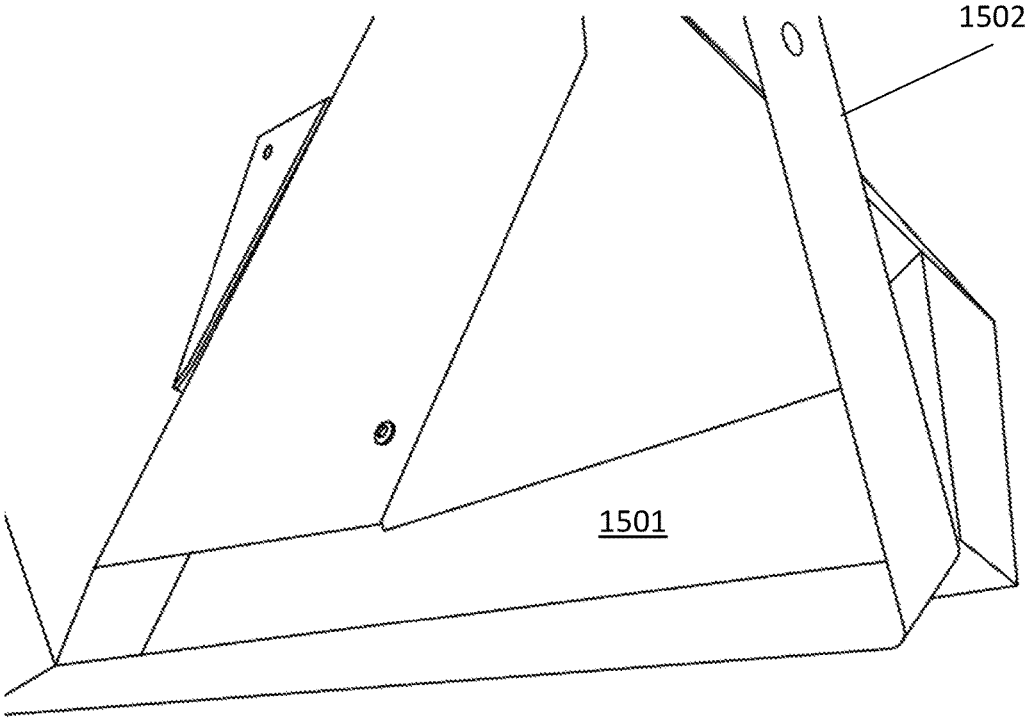
FIG. 10 is a schematic illustration of an example embodiment of the present invention, formed by folding sheet metal and riveting at appropriate locations.
Figures 11, 12:
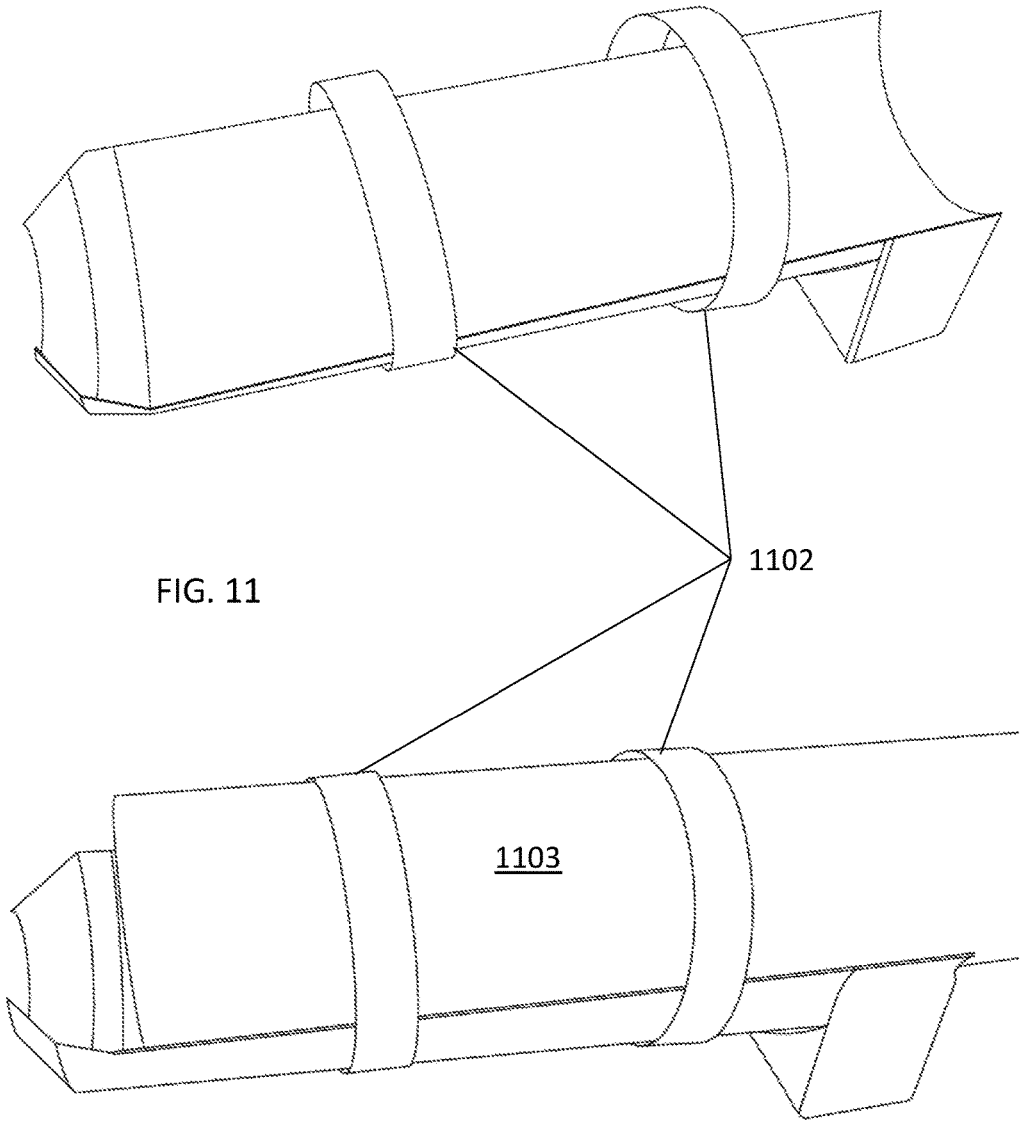
FIG. 11 is a schematic illustration of an example embodiment of the present invention, formed by folding and curving sheet metal.
FIG. 12 is a schematic illustration of an example embodiment of the present invention, formed by folding and curving sheet metal.
Figure 13:
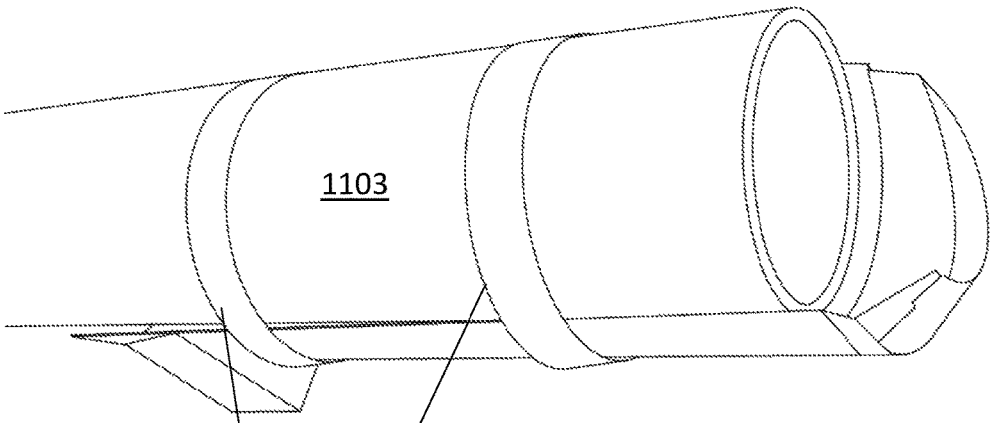
FIG. 13 is a schematic illustration of an example embodiment of the present invention, formed by folding and curving sheet metal.
Figure 14:
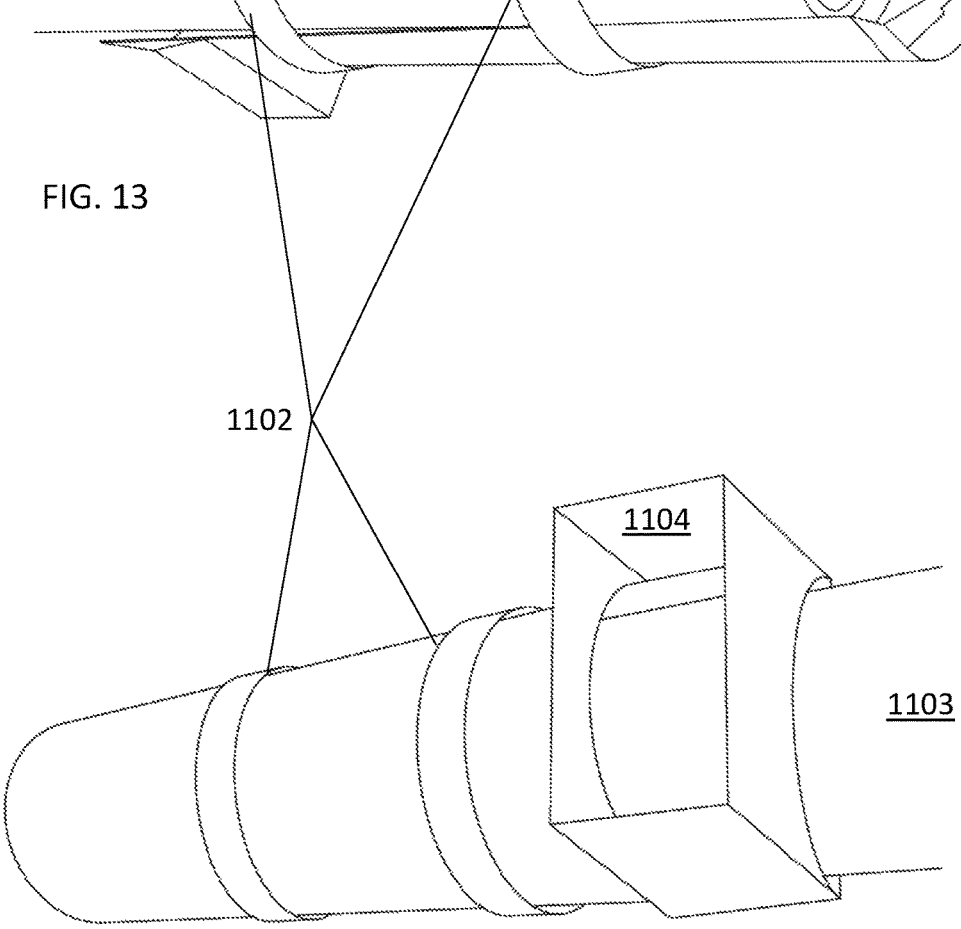
FIG. 14 is a schematic illustration of an example embodiment of the present invention, formed by folding and curving sheet metal.

Embodiments of the present invention can be fabricated from available sheet goods such as sheet metal. Sheet metal can be cut and folded along lines as shown in FIG. 4 to form an example embodiment. Other cut and fold patterns can also be determined by those skilled in the art. Further, embodiments can be fabricated by joining multiple separate pieces to form the desired shape. Embodiments can also be fabricated of plastic (e.g., injection molded and thermoformed), composites (e.g., fiberglass), cast or die-cast metals, or other sheet goods. Paint and other surface coatings an also be applied.

Embodiments can provide for attachment to canales by, as examples, nailing or screwing to a canale, placing a strap that is either integral to the apparatus or a separate piece around the apparatus and canale, or incorporating the apparatus into a new canale (e.g., making a canale for new construction with an apparatus according to the present invention integrated into the metal that frequently lines a canale). A strap can be incorporated into the apparatus, mounted with the apparatus, and extended above the apparatus and around the canale. Secure fastening of the strap (or straps) can provide for secure mounting of the apparatus with the canale. As another example, an embodiment can comprise a portion of canale, e.g., molded as part of a complete canale structure configured to be attached to a roof.

FIGS. 15-18 are photographs of example embodiments of the present invention. The example embodiment in FIG. 15 comprises a catchment portion 1501 made of folded sheet metal such as galvanized steel or aluminum, and mounts via a strap 1502 to a canale 1503. The catchment portion connects with a downspout 1504 that can connect with water distribution or collection systems. The catchment portion is wide enough to catch water flowing from any portion of the canale. The catchment portion and the strap together provide a wall substantially blocking the flow of water that would otherwise flow out of the canale and fall freely to the ground. The example in the figure shows a catchment portion with a bottom floor slightly angled from horizontal, and a front wall that is slightly angled from vertical. Note that water falling from a canale transitions from roughly horizontal flow in the canale to roughly vertical flow as it falls toward the ground. The catchment portion can block this flow with a floor/wall as shown in the figure, and can also comprise just a floor that catches water as its flow is more vertical falling from the canale, or a floor that is angled or curved to effectively direct water from the canale into the catchment portion.

Note that the wall does not completely block the flow of water out of the canale—if water is flowing at high velocity then some of the water can overshoot the wall, and if the catchment portion is unable to accept all the water falling into it from the canale then water can freely overflow the wall. Such situations can arise, as examples, if rain fall is heavier than can be accommodated by the catchment portion, downspout, and any distribution or collection system, or if there is a blockage or other flow reduction in the catchment portion, downspout, or elsewhere that causes water to leave the catchment portion through the downspout at a lesser rate than water enters the catchment portion from the canale. This ability to continue to drain the roof even if the water flow is too heavy for the collection system (due to heavy rain, or blockages or flaws in the collection system, or any combination of factors) is important to ensure that the use of the example embodiment does not lead to undesirable water accumulation in the canale or on the roof.

Note also that the catchment portion mounts with the canale via screws through the strap in the canale, and via screws through flanges in the catchment portion into the underside of the canale. Accordingly, the roofing material does not need to be pierced (a common cause of leaks), and the canale does not need to be modified, to install the example embodiment.

Figure 16:
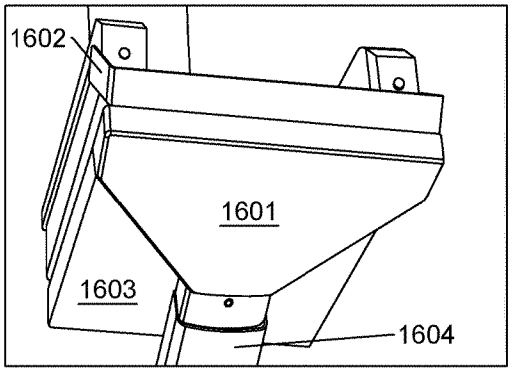
FIG. 16 is a schematic illustration of an example embodiment of the present invention.

FIG. 16 is a photo of an example embodiment of the present invention. A catchment portion 1601 mounts with a canale 1603 via a strap 1602 similarly to that described in the example embodiment in FIG. 15. The catchment portion communicates water from the canale to a downspout 1604. The catchment portion and strap in this example embodiment are made from sheet copper, desirable at least for esthetic purposes in some applications. The catchment portion and strap together form a wall as described above.

Figure 17:
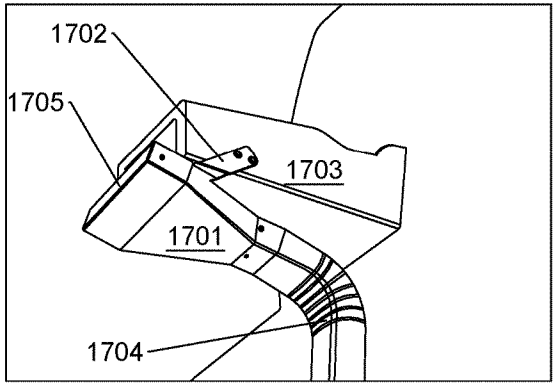
FIG. 17 is a schematic illustration of an example embodiment of the present invention.

FIG. 17 is a photo of an example embodiment of the present invention. A catchment portion 1701 is formed of folded sheet metal, and mounts with a canale 1703 via a strap 1702. The catchment portion is mounted such that a wall 1705 is presented to water flowing from the canale. The wall partially blocks the flow of water, but allows water to overflow the wall and the catchment portion in a similar manner as described above. Catchment portion communicates water from the canale to a downspout 1704. Note that the strap in this example embodiment does not form part of the wall, and mounts with the canale via screws through the strap into the sides of the canale. The catchment portion is formed such that when the top of the catchment portion is in contact with the bottom of the canale the wall will extend a suitable amount into the anticipated flow of water from the canale. This example embodiment can obviate the need for screws into the bottom of the canale, and can reduce the time required to correctly mount the example embodiment.

Figure 18:
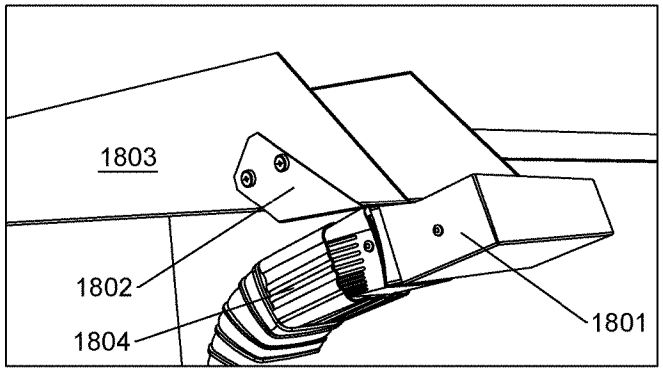
FIG. 18 is a schematic illustration of an example embodiment of the present invention.
Figure 15:
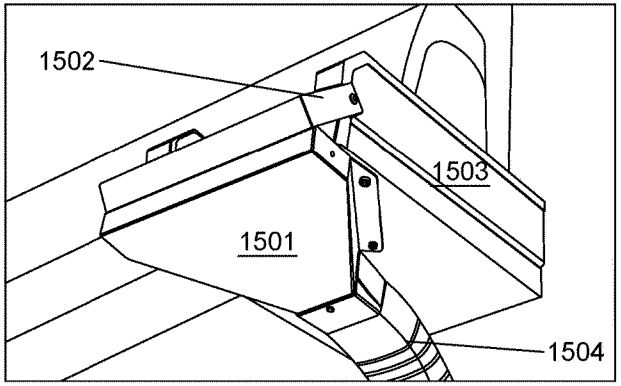
FIG. 15 is a schematic illustration of an example embodiment of the present invention.

FIG. 18 is a photo of an example embodiment of the present invention. A catchment portion 1801 can be formed of folded sheet metal. The catchment portion includes a portion that is sized to fit within a conventional downspout 1804 such that water flowing down form the catchment portion will enter the downspout. The sheet metal used for the catchment portion can also be used to form tabs 1802 (shown in the figure, a similar tab is blocked from view by the canale 1803). The tables mount, e.g., with sheet metals screw or bolts, with the sides of a metal canale 1803. The overlap of the tabs, catchment portion, and canale, and the relative angles, can be adjusted at installation by simply bending the parts as desired. The catchment portion, as with the other example embodiments, provides a wall that blocks the flow of water from the canale and direct it to the downspout under anticipated water flow conditions. If the water flow exceeds the capacity of the catchment portion and downspout, then water can overflow the catchment portion wall to ensure that water does not puddle on the roof even in heavy rains or when the water collection system is not able to accept all the water (e.g., becomes full or clogged with debris).

The present invention has been described in connection with various example embodiments. It will be understood that the above description is merely illustrative of the applications of the principles of the present invention, the scope of which is to be determined by the claims viewed in light of the specification. Other variants and modifications of the invention will be apparent to those of skill in the art.

I claim:

1. An apparatus for collecting water from a canale that extends from an edge of a roof and has an open end distal from the roof through which water exits the canale, the apparatus comprising:

(a) a catchment portion defining a volume, which volume is open for at least a portion of a top region, and is configured to communicate water with a water collection system, wherein the catchment portion comprises a bottom, a front wall, and side walls, wherein the front and side walls sealingly engage the bottom, and comprising an outlet port that allows water to flow out of the catchment portion, wherein the outlet port is between the front wall and the open distal end of the canale when the apparatus is mounted with the open distal end of the canale and (b) an attachment portion configured to engage the canale, the roof, or a wall supporting the roof, and mount the apparatus such that the catchment portion is positioned at the open end distal from the roof so that water exiting the open end distal from the roof will either flow into the catchment portion or overflow the catchment portion, without remaining in the canale, if water from the canale flows into the catchment portion faster than the catchment portion communicates water to the water collection system, and wherein the attachment portion comprises one or more tabs extending from the attachment portion toward and engaging the canale when the front wall is positioned to catch water flowing from the canale.

2. A apparatus as in claim 1, wherein the attachment portion comprises one or more tabs that extend from the side wall.

3. A apparatus as in claim 1, wherein the attachment portion comprises one or more tabs that extend from the outlet portion.

4. An apparatus as in claim 1, comprising sheet metal bent to form the catchment and attachment portions.

5. An apparatus as in claim 1, wherein the catchment portion comprises an outlet port configured to communicate water to a downspout.

6. An apparatus as in claim 1, wherein the attachment portion is configured to engage the canale without perforating the bottom of the canale.

7. An apparatus as in claim 1, wherein the attachment portion is configured to engage the canale, the roof, or a wall supporting the roof without perforating the canale or the roof.

8. An apparatus as in claim 1, wherein the one or more tabs extend from the front wall.

9. An apparatus for collecting water from a canale and communicating water to a downspout, comprising:

(a) a floor, having a width at a first end at least as large as the width of the canale and a width at a second end less than the width of the downspout and less than the width of the canale;

(b) first and second side walls, sealingly engaging the floor along its sides from the first end to the second end, and extending above the floor a first distance, and, together with the floor, fitting inside the downspout at the second end of the floor;

(c) a front wall, sealingly engaging the floor along the entire width of the first end of the floor and with the first and second side walls, and extending above the floor at least the first distance;

(d) a plurality of mounting elements, mounted with at least one of the front wall, the floor, and the side walls, configured to attach to one or more outer surfaces of the canale and support the apparatus.

10. An apparatus as in claim 9, wherein the mounting elements comprise first and second tabs, each mounted with a side wall and extending away from the interior volume formed by the floor and the side walls, with each tab having one or more holes through which fasteners can engage a bottom surface of a floor of the canale.

11. An apparatus as in claim 9, wherein the mounting elements comprise first and second tabs, each mounted with a side wall and extending away from the interior volume formed by the floor and the side walls, with each tab having one or more holes through which fasteners can engage an outer surface of a side of the canale.

12. An apparatus as in claim 9, wherein the front wall extends above the floor by the first distance plus a mounting distance, and wherein the mounting elements comprise a tab mounted with each end of the front wall at that portion of the front wall that extends above the floor by more than the first distance, wherein each tab extends away from the front wall in the direction of the side walls and has one or more holes through which fasteners can engage an outer surface of a side of the canale.

* * * * *